United States Patent [19]

Czikk et al.

[11] Patent Number: 4,663,243

[45] Date of Patent: May 5, 1987

[54] FLAME-SPRAYED FERROUS ALLOY ENHANCED BOILING SURFACE

[75] Inventors: Alfred M. Czikk, Amherst; James W. Kern, Tonawanda, both of N.Y.

[73] Assignee: Union Carbide Corporation, Danbury, Conn.

[21] Appl. No.: 437,122

[22] Filed: Oct. 28, 1982

[51] Int. Cl.[4] ..... B32B 15/02; B22F 3/02

[52] U.S. Cl. ..... 428/559; 427/423; 428/553; 428/937; 165/133

[58] Field of Search ..... 165/133; 427/423; 428/557, 553, 559, 937

[56] References Cited

U.S. PATENT DOCUMENTS

| | | | |
|---|---|---|---|
| 2,845,366 | 7/1958 | Schroeder | 117/65 |
| 2,920,001 | 1/1960 | Smith et al. | 117/21 |
| 3,077,659 | 2/1963 | Holzwarth | 29/197 |
| 3,384,154 | 5/1968 | Milton | 165/1 |
| 3,496,752 | 2/1970 | Kun et al. | 72/324 |
| 3,523,577 | 8/1970 | Milton | 165/110 |
| 3,637,437 | 1/1972 | Goldberger | 136/120 |
| 3,821,018 | 6/1974 | Grant | 117/94 |
| 3,990,862 | 11/1976 | Dahl et al. | 29/191.2 |
| 4,060,125 | 11/1977 | Fujie et al. | 165/133 |
| 4,093,755 | 6/1978 | Dahl et al. | 427/299 |
| 4,232,056 | 11/1980 | Grant et al. | 427/37 |
| 4,354,550 | 10/1982 | Modahl et al. | 165/133 |
| 4,359,086 | 11/1982 | Sanborn et al. | 165/133 |

FOREIGN PATENT DOCUMENTS 1388733 3/1975 United Kingdom .

OTHER PUBLICATIONS

Flame Spray Handbook, vol. 1, "Wire Process", by H. S. Ingham and A. P. Shepard, Metco, Inc., Long Island, New York 1969 pp. A-69 and A-70.

Flame Spray Handbook, vol. 2, "Powder Process", by H. S. Ingham and A. P. Shepard, Metco, Inc., Long Island, New York 1969, pp. 35-36.

*Primary Examiner*—Shrive P. Beck

*Attorney, Agent, or Firm*—Norman L. Balmer

[57] ABSTRACT

A porous boiling surface and method of making, which surface comprises a flame-sprayed matrix of ferrous alloy powder on a metal substrate, the matrix being characterized by having irregularly spaced, angled macropores which extend partly through the thickness of the matrix and which improve the boiling perfrmance of the surface.

10 Claims, 4 Drawing Figures

FIG. 1
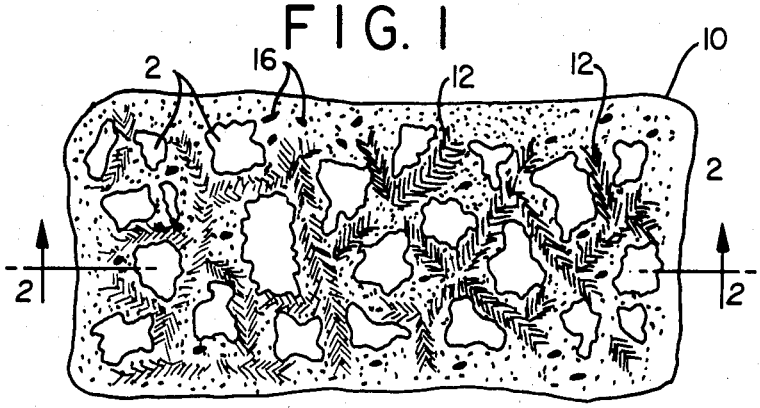
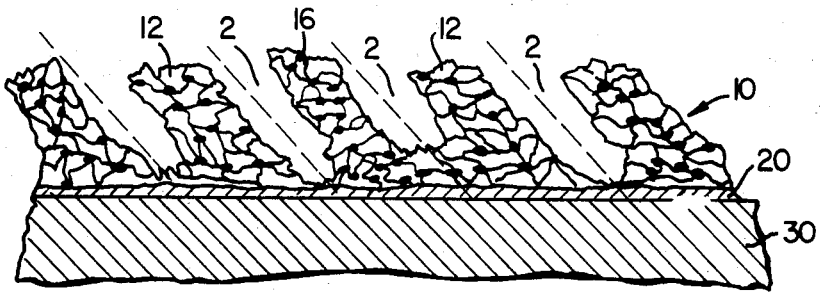
FIG. 2
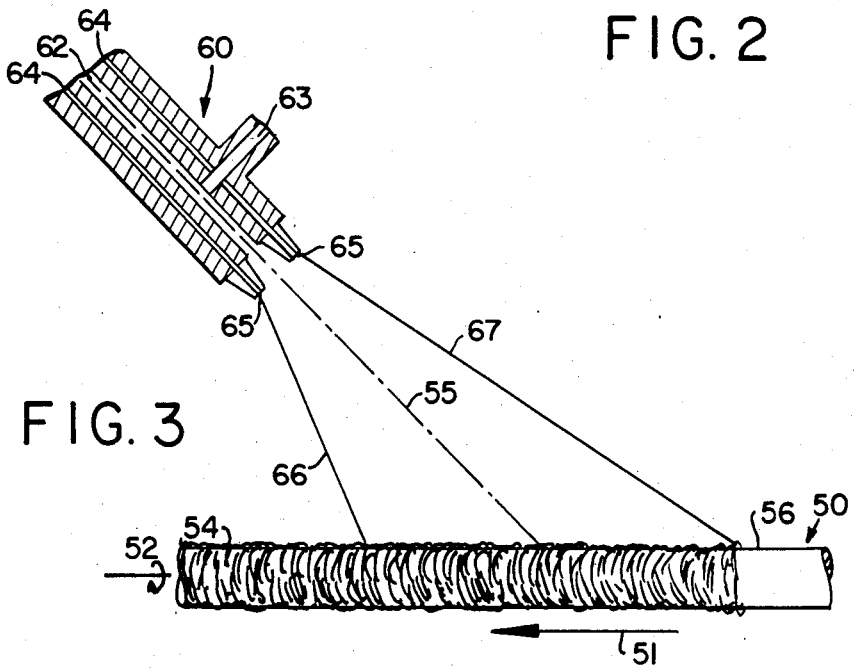
FIG. 3

FLAME-SPRAYED FERROUS ALLOY ENHANCED BOILING SURFACE

DESCRIPTION

1. Technical Field

This invention relates to a flame-sprayed ferrous alloy enhanced boiling surface and a method of making the surface. More specifically, the invention relates to a flame-sprayed matrix of ferrous alloy particles on a metal substrate, the matrix having nucleate boiling sites therein and macropores which provide improved access of liquid to and vapor from the nucleate boiling sites.

2. Background Art

Boiling heat transfer, or nucleate boiling, as used herein refers to boiling wherein vapor bubbles are initially formed at a given site, generally a pore having access to a heat source and a liquid to be heated. As liquid enters the nucleate boiling site it vaporizes, increasing the vapor bubble until a portion of the bubble detaches and flows away from the active site. Enough vapor remains at the active site to continue nucleate boiling whereby entering liquid rapidly vaporizes enhancing the heat transfer from the heat source to the liquid.

Boiling heat transfer is commonly utilized in many separation process applications such as distillation which uses boiling for heating and cooling columns and refrigeration processes which utilize boiling heat transfer for cooling. Generally a metal tube or surface is used as the heat transfer interface. Since it is well-known that smooth metal surfaces have relatively poor performance in boiling heat transfer service, attempts have been made to modify such smooth metal surfaces so as to produce enhanced boiling heat transfer surfaces.

The heat transfer art has many examples of enhanced boiling surfaces. One major category of improved boiling surfaces includes those surfaces commonly referred to as porous boiling surfaces. These surfaces generally comprise a uniform layer of a metal matrix attached to a smooth metal substrate such as a heat transfer tube. The interstitial pores within the metal matrix function as nucleate boiling sites.

U.S. Pat. No. 3,384,154 to Milton describes what is considered the basic porous boiling surface structure. The patent gives a considerable description of nucleate boiling and indicates the nature of a porous boiling surface whereby the pores maintain trapped vapor bubbles and are interconnected for continuous boiling action wherein vapor is removed from and liquid supplied to the nucleate boiling site. Substantially no superheating of the bulk liquid occurs. Milton's porous boiling surface is described as a uniform layer of thermally conductive particles intricately bonded together to form interconnected pores of a capillary size having equivalent pore radius less than about 0.0045 inch (0.011 cm). The structure of the boiling surface itself is composed of essentially a uniform mixture or combination of individual particles and then in turn, the layer itself is uniformly applied to the substrate. The disclosed method for producing the porous boiling surface layer comprises thermally bonding a layer of fine metal particles to the base heat transfer surface to form an interconnected porous metal matrix.

A porous metal matrix boiling surface may be formed by attaching a suitable powder or a granulated material onto a smooth substrate by means of a sintering process wherein the temperature of the entire metal matrix is raised to close to its melting temperature at which temperature the matrix becomes joined at the boundaries between adjacent matrix particles and between matrix particles and the substrate. Another way in which the matrix may be attached to the substrate is by brazing wherein a suitable adhesive substance is used to join the matrix particles to each other and to the substrate. Both of these processes are expensive and require controlled heating of the substrate and the metal matrix to elevated temperatures.

Another type of improved boiling surfaces are those surfaces that can be considered as textured surfaces. These surfaces comprise a uniform modification of the substrate surface by mechanical means to form suitable cavities on the surface that would function as nucleate boiling sites. These textured surfaces are attempts to modify the surface of the substrate by mechanically scoring, cutting or otherwise enscribing a combination of ridges, tunnels, and/or valleys in a relatively regular pattern in order to result in nucleate boiling sites on the surface and thereby improved boiling performance.

Recently flame spraying, also known commonly as metal spraying, techniques have been used to apply a suitable porous boiling surface to a smooth substrate. Flame spraying utilizes an intense flame to entrain and direct molten or partially molten metal against a surface. Flame spraying may provide a more readily adaptable and economical means for producing a porous boiling surface than sintering or brazing.

U.S. Pat. No. 3,990,862 to Dahl et al describes a flame-sprayed porous metal matrix formed of particles of oxide film-forming metal randomly attached to each other and to the metallic substrate. The unconnected portions between the particles define interconnected open-cell nucleation sites capable of aiding change of state from a liquid to a gas. The disclosure associated with this patent is directed primarily towards the benefits of the oxide layers surrounding the particles and which reportedly aid in the interconnection of those individual particles. The disclosure notes the desirability of nucleation sites similar to those obtained with the porous boiling surface associated with the surface described in U.S. Pat. No. 3,384,154 to Milton.

The patent to Dahl et al notes that flame spraying of metallic powders depends on a variety of parameters including gas balance, spray distance and angle, type of powder including particle size distribution, type of alloy ductility and melting point, type of fuel gas, powder feed rate, substrate surface temperature, presence of contaminants, shape of substrate and type of spray nozzle without demonstrating any specific dependencies. This patent and other art related to flame spraying give some indication of the difficulty associated with choosing proper flame spraying conditions for particular applications.

U.S. Pat. No. 4,232,056 to Grant et al discloses a flame spraying method for producing an aluminum porous boiling surface having exceptional mechanical strength and the high degree of open-cell porosity required for effective boiling heat transfer. The method includes the use of a flame spray gun which utilizes an inert gas, a highly reducing flame and an aluminum wire feedstock to produce a porous boiling surface which does not contain substantial oxide material. The procedure disclosed includes a two-step technique whereby there is first formed a thin, relatively dense bond layer followed by a relatively open and porous top layer which provides the porous boiling surface.

General instructions related to flame spraying are found in the *Flame Spray Handbook* published by Metco, Inc., 1967. In part the Handbook mentions that the angle at which the spray is directed against the substrate has a pronounced effect on the physical properties and structure of the sprayed coating. The angle of flame spraying, as used herein, refers to the angle formed by the centerline of the sprayed flame and the centerline of the substrate in the case of a cylindrical substrate or the surface of the substrate in the case of a flat substrate. The Handbook cautions that employing an angle of flame spraying of less than 45° will generally produce a non-uniform, wavy structure. Since the prior art approaches to flame spraying enhanced boiling surfaces are directed to a uniform layer, the angle of flame spraying in all the prior art is taught to be about 90°, that is, about perpendicular to the substrate.

To date, only a few porous metal deposits have been successfully flame-sprayed as enhanced boiling surfaces. A flame-sprayed, copper-enhanced boiling surface is taught in British Pat. No. 1,388,733 to Thorne. Flame-sprayed, aluminum-enhanced boiling surfaces are taught in U.S. Pat. Nos. 4,093,755 to Dahl et al and 4,232,056 to Grant, et al. While copper and aluminum porous boiling surfaces can be flame-sprayed, both lack corrosion resistance to certain environments. Many process applications, especially those dealing with moist and/or sulfur-containing components are detrimental to these flame-sprayed porous boiling surfaces.

The heat transfer field has long needed a flame-sprayed ferrous alloy-enhanced boiling surface, such as carbon steel or stainless steel enhanced boiling surfaces, which are inexpensive and may have a high degree of corrosion resistance. Ferrous alloy porous boiling surfaces can be manufactured by sintering or brazing, but such manufacturing techniques are relatively expensive. Accordingly, there exists a need for a relatively inexpensive flame-sprayed, high - performance, ferrous alloy porous boiling surface.

Hence, it is one object of this invention to provide a ferrous alloy enhanced boiling surface that has high boiling performance, low fabrication cost, and may have high corrosion resistance under various service conditions.

Another object of this invention is to provide a method by which a porous ferrous alloy deposit may be applied onto a metal substrate by flame spraying techniques.

These and additional objects of this invention will become more fully apparent from the following description and accompanying drawings.

DISCLOSURE OF THE INVENTION

This invention relates to an enhanced boiling surface comprising a metal substrate and a flame-sprayed matrix of ferrous alloy particles thereon, the matrix having nucleate boiling sites therein and further characterized by having randomly disposed macropores therein which extend inwardly from the outer surface of the matrix to a depth equal to at least one third the thickness of the matrix and which macropores have axial centerlines which intersect the substrate surface at an acute angle, which macropores enhance boiling by providing improved access of liquid to and vapor from the nucleate boiling sites throughout the matrix.

Preferably, the invention relates to a flame-sprayed matrix of ferrous alloy powder comprising a dense base layer for bonding to a metal substrate and at least one porous layer having nucleate boiling sites and macropores therein for boiling enhancement.

The invention also relates to a method of depositing on a metal substrate a porous ferrous alloy boiling surface having macropores therein to enhance boiling, which method comprises the steps of:

(a) aligning an oxy-fuel spray gun in relationship to a metal substrate such that the centerline distance between the nozzle of the spray gun and the substrate is from about 4 inches (10.2 cm) to about 6 inches (15.2 cm) and said spray gun is inclined so that the angle of flame spraying is from about 30° to about 50° ;

(b) entraining ferrous alloy powder in an inert gas stream;

(c) injecting the inert gas stream into a reducing oxy-fuel flame which is dispensed from the nozzle of the spray gun toward the substrate; and (d) providing relative movement between the oxy-fuel flame and the substrate so as to apply at least one layer of ferrous alloy powder onto the substrate.

As used herein, the term macropore refers to those cavities in the ferrous alloy matrix having openings at the outer surface of the matrix, which is that surface farthest from the substrate, and which macropores can not effectively trap vapor so as to function as nucleate boiling sites but which contribute to the highly enhanced boiling characteristics of this surface by providing improved fluid access to nucleate boiling sites within the ferrous alloy matrix and removal of vapor bubbles therefrom.

The macropores are formed when ferrous alloy powder is flame sprayed onto the substrate at an inclined angle to the substrate surface. As each particle of ferrous alloy impinges onto the substrate or against another particle it shields a space behind itself from exposure to subsequent particles which are also flame sprayed at an inclined angle. The macropores develop having axial centerlines which are generally inclined at an acute angle towards the direction in which the ferrous alloy matrix was flame sprayed.

A top view of the flame-sprayed ferrous alloy matrix shows that the macropores are randomly disposed. This view is depicted in FIG. 1. The macropores themselves have irregularly shaped openings at the outer surface of the matrix. The macropore openings may have an X:Y axis width ratio of from about 1:1 to about 10:1, preferably of about 4:1. The width of an opening may vary from about 0.001 inch (0.003 cm) to about 0.010 inch (0.025 cm).

When viewed in vertical cross-section along a plane parallel to the direction in which the matrix was flame sprayed and perpendicular to the substrate surface, the shape and frequency of the macropores become apparent. This view is illustrated in FIG. 2. The macropores are seen to incline at an acute angle of from about 40° to about 60° along their centerline from the surface of the substrate.

A macropore extends from the outer surface of the ferrous alloy matrix to a depth equal to at least one third the thickness of the matrix. The ferrous alloy matrix is viewed as having a thickness measured from the interface between the substrate and the matrix to a surface in touching contact with the highest average peaks of the matrix and which surface is approximately parallel to and a substantially equal perpendicular distance from the substrate/matrix interface. A macropore may extend as far as to the metal substrate. Since a macropore typically inclines at an acute angle of from between about 40° and 60° from the surface of the substrate, the depth of the macropore, as measured along its centerline, may exceed the measured thickness of the matrix layer.

In vertical cross-section macropores appear at a frequency of from about 20 to about 200 macropores per linear centimeter. Optimum boiling performance is achieved when the macropores occur longitudinally at a rate of from about 30 to about 80 macropores per linear centimeter, which represents a balance between the ferrous alloy matrix wherein nucleate boiling takes place and the macropores which provide the liquid for nucleate boiling.

Nucleate boiling sites occur throughout the ferrous alloy matrix. Such sites are interconnected to the outer surface of the matrix or to the sidewalls of the macropores and therefore have access to the liquid which bathes the porous boiling surface. Nucleate boiling sites may also exist along the sidewalls of the macropores. Within the nucleate boiling sites liquid continually replenishes boiling fluid which has changed phase from liquid to gas and left the site as a vapor bubble. The macropores that extend into the thickness of the ferrous alloy matrix facilitate the movement of liquid to these nucleate boiling sites within the ferrous alloy matrix and the removal of vapor bubbles therefrom, and so contribute to the particularly high boiling performance of this enhanced surface.

Nucleate boiling generally occurs in pores within the ferrous alloy matrix which have diameters of from about 0.00005 inch (0.00013 cm) to about 0.0075 inch (0.019 cm). For an optimum porous boiling surface when the liquid is water, it is preferred that the nucleate boiling sites have pore diameters of from about 0.0015 inch (0.004 cm) to about 0.0075 inch (0.019 cm). For an optimum enhanced boiling surface when the liquid is a cryogen, the nucleate boiling sites preferably have pore diameters ranging between about 0.00005 inch (0.00013 cm) and about 0.0025 inch (0.0064 cm). Pores of these sizes do occur in the flame-sprayed ferrous alloy matrix of this invention.

Generally, the ferrous alloy matrix is flame sprayed onto the substrate so as to have a thickness of from about 0.003 inch (0.01 cm) to about 0.030 inch (0.08 cm), preferably from about 0.006 inch (0.02 cm) to about 0.010 inch (0.03 cm). If the porous matrix layer is too thick then the conductance of heat from the substrate and the flow of liquid and vapor throughout the porous boiling surface will be restricted and the efficiency of the boiling surface will be decreased. If the ferrous alloy layer is too thin there will not be sufficient nucleate boiling sites for high performance boiling.

In characterizing the porous boiling surface of this invention reference may be made to the gross void fraction of the porous boiling surface, which is a measure of the total void volume through the thickness of the ferrous alloy matrix layer. The gross void fraction may be further described as comprising a major void fraction and a minor void fraction. The major void fraction is that fraction of the total volume of the porous matrix layer that is due to the presence of macropores and is an approximate measurement of the volume of the porous boiling surface occupied by the macropores. The minor void fraction is that fraction of the total porous matrix layer volume that represents nucleate boiling sites and their associated interconnecting channels. Ferrous alloy enhanced boiling surfaces in keeping with this invention have a major void fraction of between about 0.10 and about 0.60 and a minor void fraction of between about 0.10 and about 0.40. Preferably, the major void fraction is between about 0.20 and 0.50 and optimally between about 0.32 and 0.42. The minor void fraction is preferably between about 0.15 and 0.30 and optimally between 0.15 and 0.18.

It is preferable, but not necessary, that the flame-sprayed matrix comprise at least two layers; a dense base layer and at least one porous layer having macropores therein. The base layer substantially covers the substrate with a thin deposit of ferrous alloy or other bonding alloy well known in the art which bonds tightly to the substrate and provides an improved bonding surface for the porous layer. This bonding layer may be from about 0.001 inch (0.003 cm) to about 0.004 inch (0.010 cm) thick. The macropores described in conjunction with the invention generally do not extend into this bonding layer.

Such a bonding layer serves as a suitable adhesion layer between the substrate and the porous layer and is not intended to significantly contribute to the enhanced boiling characteristics of the surface. When a roughened-surface substrate, such as one that has been subjected to grit blasting or acid etching, is used, a bonding layer may not be required as the porous layer may be sufficiently bound to the rough surface of the substrate. If such is the case, then the macropores in the ferrous alloy matrix may extend to the surface of the substrate.

The porous ferrous alloy layer which has been earlier described and which contains the macropores that characterize this porous boiling surface typically has a thickness that is at least four times as thick as the base layer, if a base layer is present.

The metal substrate may be nickel, copper, aluminum, carbon steel, stainless steel, titanium or any alloy thereof or other metal which provides the required heat transfer properties and corrosion resistance for an intended application. The ferrous alloy surface may be carbon steel, stainless steel such as 304 stainless steel or any such steel alloy. Examples of preferred ferrous alloy matrix and metal substrate combinations include stainless steel particles on a stainless steel substrate, stainless steel particles on a titanium substrate and carbon steel particles on a carbon steel substrate. The metal substrate may have the form of well-known heat exchanger shapes such as flat, curved and tubular surfaces, with or without fins.

The ferrous alloy to be flame sprayed in accordance with this invention is provided in powder form, preferably whereby at least fifty weight percent of the powder passes through a U.S. standard 325 mesh screen and is most preferably a powder whereby at least 95 weight percent of the powder passes through a U.S. standard 325 mesh screen.

The structure of the ferrous alloy matrix as disclosed in this invention is obtained by utilizing an oxy-fuel metal spray gun to flame spray a ferrous alloy powder at an angle against the metal substrate. The flame spray process produces a strong mechanical bond between the matrix and the substrate. Many variables in the flame spraying process will affect the structure of the ferrous alloy matrix that is sprayed. In accordance with this invention it has been found that certain variables have a controlling influence on obtaining the inventive flame-sprayed ferrous alloy matrix having irregularly spaced, angled macropores therein. These variables are type of thermal spray gun, angle at which the gun is inclined towards the substrate and the form in which the ferrous alloy is presented for flame spraying. As such, it has been found that the porous layer must be applied by spraying a ferrous alloy powder with an oxy-fuel spray gun that is positioned so that the angle of flame spraying is between about 30° and 50°.

The oxy-fuel spray gun generally utilizes a gas balance that is proportioned so as to yield a reducing flame. As used herein, a reducing flame is a flame produced by a reactive gas mixture having an oxidizing-to-fuel gas mole ratio of less than seventy-five percent of the stoichiometric ratio. Fuel gases such as propane, natural gas and hydrogen may be used. Acetylene is the preferred fuel because of its high combustion temperature. The stoichiometric mole ratio of oxygen-to-acetylene needed to insure complete oxidation of the acetylene to carbon dioxide and water products is 2.5:1. Therefore, in flame spraying metal powder in accordance with this invention so as to produce a reducing flame, an oxygen-to-acetylene mole ratio of less than 1.8:1 is used, preferably about 1.4:1.

A non-oxidizing carrier gas is used to transport the melted powder to the substrate. Preferably an inert gas such as nitrogen is used. When the flow rate of the carrier gas is between about 125 and 250 cubic feet per hour the gas is preferably transporting between about 100 and 300 grams of ferrous alloy per minute. Preferably, the carrier gas flow rate is about 200 SCFH and the ferrous alloy feed rate is about 300 grams per minute.

The oxygen-fuel spray gun is positioned so that the centerline distance from the nozzle to the substrate is between about 4 inches (10.2 cm) and about 6 inches (15.2 cm) preferably about 4.75 inches and is oriented at an angle of between about 30° and about 50°, preferably about 40° to 45° from the substrate surface. As is well-known in the flame-spraying art, cool air jets may be employed to shape and direct the ferrous alloy-containing flame toward the substrate.

When the ferrous alloy to be flame sprayed is in the form of a bar or wire, the structure described herein is not obtained. Whereas prior art flame sprayed metals such as copper and aluminum which have a definite melting point, a ferrous alloy generally does not liquify uniformly at a set temperature. A flame sprayed ferrous alloy surface utilizing a wire feed requires a high temperature to insure that the wire feed has liquified and is characterized by regions of relatively dense material that do not possess the requisite nucleate boiling sites. It is believed that the use of powder feed aids in obtaining the inventive structure as the powder particles may not completely melt when flame sprayed and so may impinge on the substrate and other particles without fully deforming. This degree of rigidity may contribute to the formation of both the macropores and the nucleate boiling sites. The use of powder feed results in control over the size of the flame-sprayed particles, enables only partial melting to occur and may increase production rates.

Preferably, the process involves the application of at least two layers; a dense base layer for strength and at least one porous layer for boiling enhancement. The at least one porous layer is applied in the manner previously described. The dense base layer may be applied in the manner previously described or in any manner well-known in the art of flame spraying. Either an oxygen-fuel spray gun or an electric arc metal spraying gun may be used with, where appropriate, either powder or wire feed materials to apply the base layer. The base layer is generally applied at a centerline spray nozzle-to-substrate distance of between about 1 inch (2.5 cm) and 4 inches (10.2 cm).

Relative motion is necessary between the nozzle of the thermal spray gun and the substrate to deposit the ferrous alloy onto the substrate. In the case of a tubular or cylindrical substrate, motion can be provided by passing the tube or cylinder in a longitudinal axial direction relative to one or more nozzles while also rotating the tube or cylinder around its longitudinal axis. The ratio of radial movement to longitudinal movement is typically from about 1:1 to about 30:1, preferably from about 3:1 to about 8:1.

To apply a porous ferrous alloy deposit onto a flat substrate surface such as a plate or disc, the flat substrate may be moved relative to one or more flame spraying nozzles in a horizontal or spiral motion. To obtain horizontal and transverse motion similar to the longitudinal and radial motion experienced by tubular shaped substrates, if desirable, a transverse movement may be imparted relative to the nozzle and substrate by oscillating the nozzle or substrate.

The orientation of the macropore centerlines to each other is dependent on the shape of the substrate and the relative movement between the ferrous alloy-containing flame and the substrate as the matrix is being formed. As an example, if the ferrous alloy matrix is flame sprayed at an angle in an axial direction towards a rotating tubular substrate, then the resultant macropores in the matrix will have centerlines which uniformly intersect the longitudinal axis of the tube at about the same acute angle in the same axial direction. If the ferrous alloy matrix is flame sprayed at an angle onto a flat substrate maintaining a fixed orientation between the direction of flame spraying and the substrate, then the centerlines of the macropores in the matrix will be aligned approximately parallel to each other. As still another example, a flat substrate such as a disc may be flame sprayed by spirally rotating a thermal spray gun which is dispensing ferrous alloy particles at an angle to the substrate therebelow, in which case the resultant macropore centerlines along any given radius from the center of the spiral will intersect the substrate at acute angles and the projections of said centerlines on the substrate will be approximately parallel to each other.

BRIEF DESCRIPTION OF DRAWINGS

The present invention will become more apparent from the following description thereof when considered together with the accompanying drawings which are set forth as being exemplary of embodiments of the present invention and are not intended, in any way, to be limitative thereof and wherein:

FIG. 1 is a drawing of a photomicrograph showing the plan view of a ferrous alloy-enhanced boiling surface in accordance with the invention;

FIG. 2 is a drawing of a photomicrograph taken along line 2—2 of FIG. 1, which shows the ferrous alloy enhanced boiling surface in vertical cross-section along a plane parallel to the direction in which the ferrous alloy deposit was flame sprayed and perpendicular to the substrate surface; and FIG. 3 is a schematic representation of an oxy-fuel gun positioned in its proper orientation with respect to a tubular metal substrate for applying a ferrous alloy matrix onto the substrate in accordance with the method disclosed herein.

In FIGS. 1 and 2 the common components have been identified with the same reference numbers.

DETAILED DESCRIPTION OF THE DRAWINGS

Figure 4:
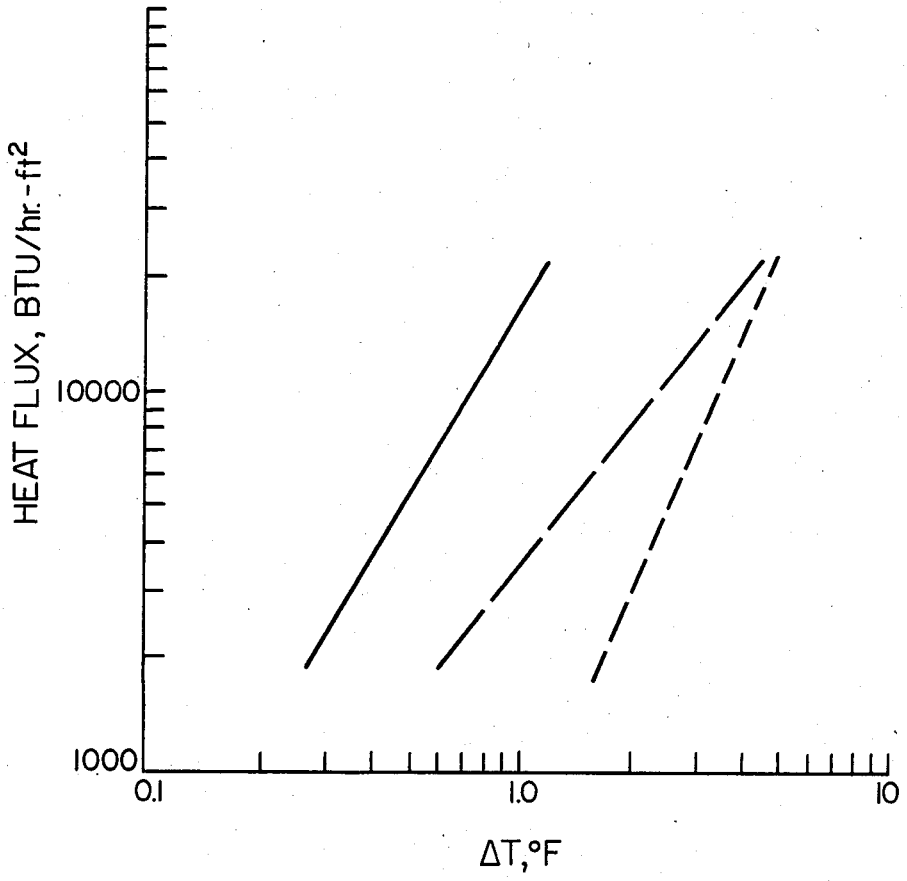
FIG. 4 compares boiling performance of the invention and the prior art.

The structural characteristics of the ferrous alloy-enhanced boiling surface of this invention are shown in FIGS. 1 and 2. As can be seen from the Figures, the ferrous alloy-enhanced boiling surface comprises a ferrous alloy matrix 10 which, when flame sprayed at an angle of from about 30° to about 50°, tends to build up in concentrated areas 12, producing macropores 2 therebetween. When utilizing an angle of flame spraying as disclosed herein, particles which impinge on the substrate shield the spaces behind them from other particles so that a macropore 2 is formed behind a wall of flame-sprayed particles. These macropores 2 are not regular or parallel to one another. Instead, macropores such as those in FIG. 1 are disposed in an irregular fashion throughout the ferrous alloy matrix 10.

The macropores 2 have one identifying characteristic; the angle at which the centerlines of the macropores incline. The angle at which the centerlines of the macropores incline is better viewed in FIG. 2. FIG. 2 shows a vertical cross-section of the porous boiling surface of FIG. 1 taken along line 2—2. The plane which is shown in FIG. 2 is parallel to the direction in which the ferrous alloy matrix 10 was flame sprayed and perpendicular to the substrate surface. The cross section shows that the porous boiling surface comprises a ferrous alloy matrix 10 which has built up as peaks 12 sheltering macropores 2 during the flame spraying process and which also contains a bond layer 20.

The thin dense bond layer 20 separates the porous ferrous alloy matrix 10 from the solid metal substrate 30. The macropores do not penetrate into the bond layer 20.

The ferrous alloy matrix 10 comprises particles having a network of interconnected nucleate boiling sites therein, some of which are shown and designated by the number 16. Heat which is conducted through the metal substrate and the ferrous alloy matrix causes liquid in the nucleate boiling sites to vaporize. Vapor bubbles form and leave. The nucleate boiling sites utilize residual vapor and incoming liquid to generate subsequent bubbles. Although it is not shown precisely in the Figures, each boiling site must provide for the entrance of liquid to the site and the egress of vapor bubbles therefrom, generally by utilizing interconnecting channels.

The macropores 2 extend to a depth equal to at least one third the thickness of the porous matrix layer 10. Some macropores in FIG. 2 extend as far as to the bond layer 20. Centerlines through these macropores point in the general direction of flame spraying and intersect the substrate 30 at an acute angle of between about 40° and about 60°. Liquid which may freely circulate in these macropores has ready access to nucleate boiling sites throughout the porous matrix. In this manner, the macropores contribute to the particularly high boiling performance of this surface.

Referring to FIG. 3, a schematic of the flame spraying process of this invention is illustrated. The metal substrate to be coated, which in this case is in the form of a tube 50, is moved in a longitudinal direction indicated by arrow 51 past an oxy-fuel flame spray gun 60. In order to coat the entire surface of tube 50, the tube is rotated about its axis as indicated by arrow 52. The longitudinal and rotation directions of substrate travel are not fixed. The substrate may travel in a longitudinal direction toward or away from the direction of flame spraying and may rotate clockwise or counterclockwise. If multiple passes are made, the substrate may move first in one longitudinal direction and then in the opposing direction. The flame spray gun 60 is positioned a distance from the tube surface, as measured by a centerline 55 from the center of the edge of gun nozzle 61 to the tube surface. According to this invention, the gun is spaced between about 4 and about 6 inches (10.2 and 15.2 cm) from the tube surface. The gun, as determined by the axial centerline 62, is oriented at an angle of between about 30° and about 50° from the longitudinal axis of the tube 50.

In FIG. 3 the flame spray gun 60 utilizes a non-oxidizing carrier gas such as nitrogen, flowing though passage 62 to aspirate or entrain a ferrous alloy powder from the feed port 63 and inject the powder into the oxy-fuel flame which extends from the end of the spray nozzle 62 to the tube surface and is shown by boundary lines 66 and 67. The flame is produced by igniting an oxy-fuel mixture which flows through passage 64 and exits the nozzle of the flame spray gun through annular ports 65. A reducing flame is achieved by using a quantity of oxident significantly below the stoichiometric amount needed to completely oxidize the fuel gas.

The heat energy needed to melt or partially melt the outer surfaces of the entrained ferrous alloy powder is supplied by the combustion of the oxy-fuel gas mixture. The melted or partially melted powder and gases form a plume which impinges on the tube 50, at an angle to form the desired enhanced boiling surface 54. Although FIG. 3 illustrates the application of a single layer coating, multiple layers may be applied as by means of a multiple gun arrangement or multiple passes in the same or opposing directions by a single gun.

In the FIG. 3 illustration, the tube 50 has not been provided with a base layer, as evidenced by the uncoated tube portion 53 although it may have received some surface preparation such as grit blasting or acid etching. However, in preferred practice, before applying the porous ferrous alloy layer by the method of this invention, the substrate is provided with a dense base layer which may be applied using standard metal spraying techniques. Use of the base coat advantageously enhances the mechanical properties of the enhanced boiling surface.

EXAMPLE I

A carbon steel enhanced boiling surface was produced by flame spraying a carbon steel matrix onto a tubular carbon steel substrate by the method of this invention An oxy-fuel gun was arranged as shown in FIG. 3 and having the following flame spraying parameters:

angle of flame spraying: 40°
centerline spray distance: 4.75 inches (12.1 cm)
powder size: 95% thru U.S. 325 mesh
powder feed rate: 322 gms/minute
carrier gas: nitrogen
carrier gas flow rate: 200 SCFH
fuel: acetylene
oxygen-to-fuel ratio: 1.4:1 rotational substrate movement: 29.5 ft/min. (90 m/min.)

longitudinal substrate movement: 10 ft/min. (30.5 m/min.)

Two passes under the above conditions were made. The sprayed surface was approximately 0.007 inches (0.018 cm) thick. The matrix was irregularly punctuated with macropores open to the outer surface of the matrix. A vertical cross-section of this carbon steel matrix taken along a plane passing through the direction of flame spraying and the longitudinal centerline of the tubular substrate showed a macropore occurrence of about 55 macropores every linear centimeter. The macropores had an average depth of about 0.006 inch (0.01 cm), an average opening width of about 0.0013 inch (0.0 cm) and inclined at a centerline angle of about 52° from the substrate surface in the direction of flame spraying. The matrix had an optically determined major void fraction of about 0.33 and a minor void fraction of about 0.16.

The boiling surface exhibited a temperature differential of about 0.75° F. (0.42° C.) at a heat flux of 10,000 BTU/hr-sq.ft. in R-12 (dichlorodifluromethane).

The boiling performance of this surface is compared to the boiling performance of a prior art brazed carbon steel surface in FIG. 4. The boiling performance of the surface in accordance with the invention is shown as a solid line; the boiling performance of the prior art brazed surface is depicted with a dashed line. As can be seen from the Figure, the boiling performance of the inventive carbon steel surface is more efficient than the brazed surface over a wide range of heat flux. At a heat flux of 10,000 BTU/hr-sg.ft., the flame sprayed surface had a $\Delta T$ of only 0.75° F. while the prior art brazed sample had a $\Delta T$ of 2.4° F.

EXAMPLE II

A stainless steel boiling surface was produced by flame spraying 304 stainless steel powder onto a tubular stainless steel substrate in accordance with this invention.

An oxy-fuel gun, arranged as shown in FIG. 3, was used to apply the stainless steel matrix. The flame spray parameters were as follows:

angle of flame spraying: 40° centerline spray distance: 4.75 inches (12.1 cm)

powder size: 38% thru U.S. 325 mesh powder feed rate: 225 gms/minute carrier gas: nitrogen carrier gas flow rate: 200 SCFH fuel: acetylene oxygen-to-fuel ratio: 1.4:1 rotational substrate movement: 9.5 ft/min. (90 m/min.)

longitudinal substrate movement: 4.8 ft/min. (12.2 m/min.)

Three passes were made to deposit three porous layers. The thickness of the stainless steel matrix was about 0.022 inch (0.056 cm). Macropores within the matrix were inclined at an angle of about 52° from the substrate surface in the direction of flame spraying. The average width of a micropore opening at the outer surface of the matrix was about 0.003 inch (0.008 cm). The average centerline depth of a macropore was about 0.026 inch (0.066 cm). Macropores occurred at a linear frequency of about 30 macropores every centimeter.

The stainless steel matrix had a visually observed major void fraction of about 0.40 and a minor void fraction of about 0.17.

The boiling performance of this stainless steel surface in water is depicted by the dotted line in FIG. 4. At a heat flux of 10,000 BTU/hr-sq.ft. this stainless steel boiling surface in water had a temperature differential of only 3.5° F. (1.9° C.).

EXAMPLE III

Several flame-sprayed enhanced boiling surfaces were prepared in accordance with this invention and under conditions wherein the ferrous alloy was supplied as either a wire or a powder and wherein the thermal spray gun was either an oxy-fuel gun or an arc gun.

In each case a porous carbon steel matrix was flame sprayed onto a tubular carbon steel substrate. Sample 1 was flame sprayed using an oxy-fuel spray gun and a carbon steel wire feed. Sample 2 was applied by using an electric arc spray gun with a carbon steel wire feed. Sample 3 was obtained in accordance with the method of this invention whereby an oxy-fuel thermal spray gun was used to flame spray a carbon steel powder.

The flame spray parameters, surface thickness and surface performance for each sample is shown below in Table 1. Only Sample 3, prepared with a carbon steel powder applied by means of an oxy-fuel gun, clearly exhibited the structure described in accordance with this invention wherein irregularly spaced, angled macropores were found disposed in the porous carbon steel matrix.

As can be seen from Table 1 the best boiling performance occurs with a porous boiling surface prepared in accordance with this invention, which performance of Sample 3 is about 4.7 times as efficient at a heat flux of 10,000 BTU/hr.sq.ft. as Sample 2 and about 6.7 times as effective as Sample 1.

TABLE 1

| Flame Spraying Parameters | | | |
|---|---|---|---|
| Sample No. | 1 | 2 | 3 |
| Materials | | | |
| Substrate | carbon steel | carbon steel | carbon steel |
| Ferrous Alloy Matrix | carbon steel | carbon steel | carbon steel |
| Flame Spray Method | | | |
| Gun Type | oxy-fuel | electric arc | oxy-fuel |
| Feed | wire | wire | powder |
| Flame Spray Parameters | | | |
| Angle of Flame Spray | 35 | 35 | 40 |
| Centerline Spray Distance (cm) | 6.4 | 14.0 | 12.1 |
| Feed Size | 0.32 cm | 0.32 cm | 95% thru U.S. 325 mesh |
| Feed Rate (gm/min) | 76 | 114 | 322 |
| Carrier Gas | nitrogen | nitrogen | nitrogen |
| Carrier Gas Flow Rate (SCFH) | 1200 | 1500 | 200 |
| Fuel | acetylene | acetylene | acetylene |
| Oxygen-to-Fuel Ratio | 2.1:1 | — | 1.4:1 |
| Substrate Speed (m/min) | | | |
| Rotational | 120 | 120 | 90 |
| Longitudinal | 10 | 8.5 | 1.8 |
| Surface Thickness (cm) | 0.028 | 0.030 | 0.020 |
| Surface Performance T °F. (°C.) @ Q/A of 10,000 BTU/hr-sq. ft. in R-12 (dichloro-difluoromethane) | 4 (2.2) | 2.8 (1.6) | 0.6 (0.3) |

While the enhanced boiling surface of this invention has been described as having macropores extending into a flame-sprayed ferrous alloy matrix whose centerlines intersect a substrate surface at an acute angle, it is expected that a structure having a porous metal matrix with macropores therethrough which macropore centerlines are about perpendicular to a substrate surface would also provide the improved access of liquid to and vapor from nucleate boiling sites in the metal matrix which characterizes the structure of this invention.

It is to be understood that other modifications and changes to the disclosed embodiments of the invention herein shown and described can also be made without departing from the spirit and scope of this invention.

We claim:

1. A method of depositing on a metal substrate a porous ferrous alloy boiling surface having macropores therein to enhance boiling which method comprises the steps of:

(a) aligning an oxy-fuel spray gun in relationship to said substrate such that the centerline distance between the nozzle of said spray gun and said substrate is from about 4 inches (10.2 cm) to about 6 inches (15.2 cm) and said spray gun is inclined so that the angle of flame spraying is from about 30° to about 50° ;

(b) entraining ferrous alloy powder in an inert gas stream;

(c) injecting said inert gas stream into a reducing oxy-fuel flame which is dispensed from the nozzle of said spray gun; and (d) providing relative movement between said oxy-fuel flame and said substrate so as to apply at least one layer of ferrous alloy powder onto said substrate.

2. The method of forming a porous boiling surface in accordance with claim 1 wherein prior to step (a) a base layer is deposited on said substrate by means of a thermal spray gun.

3. The method of forming a porous boiling surface in accordance with claim 1 wherein said reducing oxy-fuel flame is produced by a reactive gas mixture having an oxidizing-to-fuel gas mole ratio of less than about seventy-five percent of the stoichiometric ratio.

4. The method of forming a porous boiling surface in accordance with claim 1 wherein said fuel is acteylene and said inert gas in nitrogen.

5. An enhanced boiling surface comprising a metal substrate and a flame-sprayed matrix of ferrous alloy particles thereon, said matrix having nucleate boiling sites therein and further characterized by having randomly disposed, irregularly shaped macropores therein which extend inwardly from the outer surface of the matrix to a depth equal to at least one-third the thickness of the matrix and which macropores have axial centerlines with approximately the same orientation one with the other and which interesect the substrate surface at an acute angle, which macropores enhance boiling by providing improved access of liquid to and vapor from the nucleate boiling sites throughout the matrix, said ferrous alloy particles being flame-sprayed in a gas stream comprising a reducing environment.

6. The porous boiling surface in accordance with claim 5 wherein said macropores occur longitudinally at a rate of from about 20 to about 200 macropores per linear centimeter.

7. The porous boiling surface in accordance with claim 5 wherein said angle at which the centerline of said macropores is inclined toward such substrate is from about 40° to about 60°.

8. The porous boiling surface in accordance with claim 5 wherein the width of said macropores is from about 0.001 inch (0.003 cm) to about 0.007 inch (0.018 cm) and the thickness of said ferrous alloy matrix is from about 0.003 inch (0.01 cm) to about 0.030 inch (0.08 cm).

9. The porous boiling surface in accordance with claim 5 wherein the major void fraction of said ferrous alloy matrix is from about 0.10 to about 0.60 and the minor void fraction is from between 0.10 and about 0.40 of the total volume of said ferrous alloy matrix.

10. The porous boiling surface in accordance with claim 5 in which said matrix comprises ferrous alloy particles flame-sprayed in powder form.

* * * * *

UNITED STATES PATENT AND TRADEMARK OFFICE

CERTIFICATE OF CORRECTION

PATENT NO. : 4,663,243

DATED : May 5, 1987

INVENTOR(S) : Alfred M. Czikk and James W. Kern

It is certified that error appears in the above-identified patent and that said Letters Patent is hereby corrected as shown below:

Column 11, line 54, "9.5 ft/min" should read --29.5 ft/min.--.

Signed and Sealed this

Twenty-ninth Day of September, 1987

*Attest:*

DONALD J. QUIGG

*Attesting Officer* *Commissioner of Patents and Trademarks*